US007827798B2

(12) United States Patent
Commaret et al.

(10) Patent No.: US 7,827,798 B2
(45) Date of Patent: Nov. 9, 2010

(54) SYSTEM FOR VENTILATING A COMBUSTION CHAMBER WALL IN A TURBOMACHINE

(75) Inventors: Patrice Andre Commaret, Rubelles (FR); Didier Hippolyte Hernandez, Quiers (FR); David Locatelli, Gex (FR)

(73) Assignee: SNECMA, Paris (FR)

( * ) Notice: Subject to any disclaimer, the term of this patent is extended or adjusted under 35 U.S.C. 154(b) by 665 days.

(21) Appl. No.: 11/780,246

(22) Filed: Jul. 19, 2007

(65) Prior Publication Data

US 2008/0019828 A1 Jan. 24, 2008

(30) Foreign Application Priority Data

Jul. 19, 2006 (FR) ..... 06 06547

(51) Int. Cl.
*F02C 1/00* (2006.01)

(52) U.S. Cl. ..... 60/751; 60/806

(58) Field of Classification Search ..... 60/751–760, 60/785, 804, 806

See application file for complete search history.

(56) References Cited

U.S. PATENT DOCUMENTS 3,437,313 A * 4/1969 Moore ..... 415/115
4,429,527 A * 2/1984 Teets ..... 60/776
4,462,204 A * 7/1984 Hull ..... 60/806
4,845,941 A * 7/1989 Paul ..... 60/776
5,555,721 A 9/1996 Bourneuf et al.
6,148,617 A 11/2000 Williams
7,568,343 B2 * 8/2009 Harris et al. ..... 60/732
2002/0069648 A1 * 6/2002 Levy et al. ..... 60/804
2005/0247065 A1 * 11/2005 Dudebout et al. ..... 60/776

FOREIGN PATENT DOCUMENTS

FR 2.030.993 11/1970

OTHER PUBLICATIONS

U.S. Appl. No. 11/780,287, filed Jul. 19, 2007, Brunet et al.
U.S. Appl. No. 12/190,105, filed Aug. 12, 2008, Commaret et al.

* cited by examiner

*Primary Examiner*—Michael Cuff
*Assistant Examiner*—Phutthiwat Wongwian
(74) *Attorney, Agent, or Firm*—Oblon, Spivak, McClelland, Maier & Neustadt, L.L.P.

(57) ABSTRACT

A system for ventilating a combustion chamber wall in a turbomachine is disclosed. The system includes a diffuser mounted at the inlet of the combustion chamber, an annular end-piece that extends downstream to an injection device for injecting ventilation air, and an annular convecting metal sheet being arranged radially between the combustion chamber and the end-piece of the diffuser in order to delimit, with an internal wall of the chamber, an annular stream for the flow of air that is stable and without separation supplying holes in the chamber and the injection device.

9 Claims, 2 Drawing Sheets

SYSTEM FOR VENTILATING A COMBUSTION CHAMBER WALL IN A TURBOMACHINE

The present invention relates to a system for ventilating a combustion chamber wall in a turbomachine comprising a centrifugal compressor and a diffuser supplying the annular combustion chamber with air.

BACKGROUND OF THE INVENTION

In a known manner, the annular combustion chamber of the turbomachine is situated in an annular space delimited by an internal casing and an external casing. The internal casing supports the diffuser whose inlet is aligned with the outlet of the centrifugal compressor and whose outlet is situated radially outside the combustion chamber.

The air coming out of the diffuser is intended primarily to enter the combustion chamber and be mixed with fuel and then burnt, and secondarily to travel round the combustion chamber to supply primary and dilution orifices of the chamber and air injection means for ventilating and/or cooling components, particularly of a turbine, situated downstream of the combustion chamber.

The diffuser is connected to an annular end-piece with a substantially L-shaped section forming the internal casing that extends downstream to the aforementioned air injection means. The internal casing delimits, with the internal wall of the chamber, an annular cavity having a relatively large volume and the air that travels round the chamber passing between the latter and the internal casing is not guided and is subjected to turbulence and separations of flow that cause pressure losses and reduce the performance of the turbomachine. This phenomenon is amplified when the chamber is inclined inward from upstream to downstream.

However, it is not possible to envisage modifying the shape of this internal casing in order to attempt to prevent these disadvantages, because this casing is a structural part that supports components and that transmits forces, so that its shape cannot be changed markedly without degrading its structural functions and without greatly increasing its weight. Furthermore, this modification would be costly.

DESCRIPTION OF THE PRIOR ART

Proposals have already been made to reduce the volume of the annular cavity situated between the internal casing and the internal wall of the combustion chamber. For example, in document U.S. Pat. No. 4,429,527, the turbomachine comprises an internal casing that extends substantially radially upstream and close to the internal wall of a radial combustion chamber, and, in document U.S. Pat. No. 5,555,721, the internal casing extends a short distance from and radially inside the internal wall of an axial combustion chamber. However, these solutions are not entirely satisfactory because they are not particularly applicable to a combustion chamber that is inclined inward from upstream to downstream. Also, they bring with them complex and costly modifications of the diffuser and of the casing of the turbomachine.

SUMMARY OF THE INVENTION

The object of the invention is in particular to provide a simple, effective and economic solution to these problems.

Accordingly, it proposes a system for ventilating a combustion chamber wall in a turbomachine comprising a centrifugal compressor supplying, via a diffuser, the combustion chamber, and an internal casing with a substantially L-shaped section that is connected to the diffuser and that extends downstream to air injection means for ventilating a turbine, wherein an annular convecting metal sheet is arranged radially between the combustion chamber and the internal casing and extends axially from the diffuser to the injection means along a radially internal wall of the combustion chamber in order to delimit, with the internal wall of the chamber, an annular stream for the flow of air without separation and with reduced pressure losses, intended to supply holes in the internal wall of the combustion chamber and the air injection means.

The annular metal sheet according to the invention provides a stable air flow without separation and with minimal pressure losses along the internal wall of the combustion chamber, which allows an optimal supply of the air injection means and of the primary and dilution orifices of the internal wall of the chamber. This convecting metal sheet has a purely aerodynamic function which the diffuser end-piece or internal casing does not have to fulfill so that the shapes of this casing and of the convecting metal sheet may be optimized independently of one another.

In a preferred embodiment, the annular convecting metal sheet extends at least partly substantially parallel to and at a short distance from the internal wall of the combustion chamber.

The upstream end of this metal sheet may be centered and attached, for example by welding, to the diffuser, or comprise a cylindrical rim centered and supported by the diffuser. The downstream end of the metal sheet may be attached, for example by welding or by bolting of an annular flange, to the air injection means.

The metal sheet advantageously comprises pressure-balancing orifices in order to limit its deformations in operation.

According to other features of the invention, the annular convecting metal sheet comprises a frustoconical mid-portion connected at its end of larger diameter to a substantially cylindrical portion extending on the opposite side to the intermediate portion, and at its end of smaller diameter to a substantially radial portion extending inward from the intermediate portion.

To make it easier to mount, the substantially cylindrical portion of the metal sheet comprises a cylindrical rim oriented away from the substantially radial portion of the metal sheet.

The invention also relates to a turbomachine, such as an aircraft turbojet or turboprop, which comprises a system for ventilating the combustion chamber wall as described above.

BRIEF DESCRIPTION OF THE DRAWINGS

The invention will be better understood and other details, features and advantages of the present invention will appear on reading the following description made as a nonlimiting example, and with reference to the appended drawings, in which.

DESCRIPTION OF THE PREFERRED EMBODIMENTS

Figure 1:
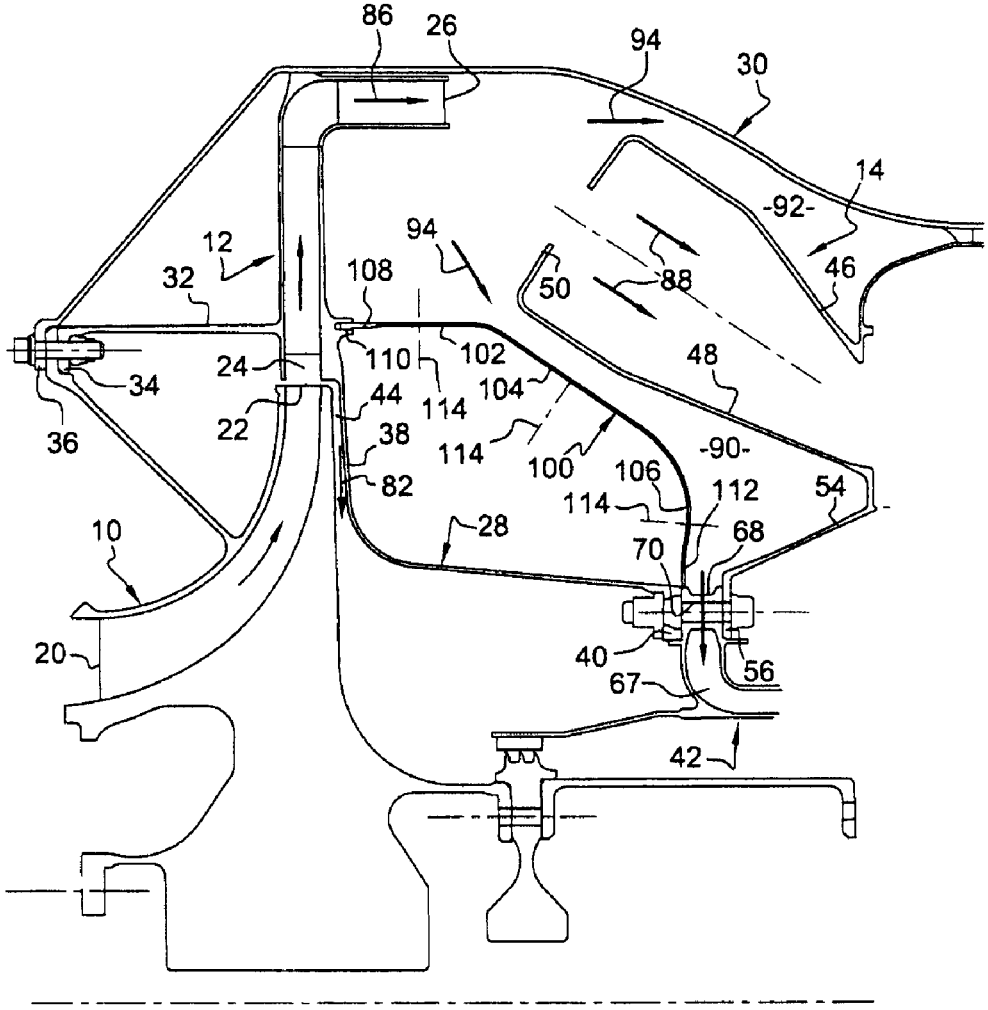
FIG. 1 is a partial schematic view in axial section of a system for ventilating a combustion chamber wall according to the invention.

FIG. 1 represents a portion of a turbomachine, such as an aircraft turbojet or turboprop, comprising, from upstream to downstream, in the direction of flow of the gases inside the turbomachine, a centrifugal compressor 10, a diffuser 12 and a combustion chamber 14.

The inlet 20 of the centrifugal compressor 10 is oriented upstream, substantially parallel to the axis of the turbomachine, and its outlet 22 is oriented radially outward, substantially perpendicularly to the axis of the turbomachine.

The diffuser 12 has a generally annular shape bent at 90° and comprises an inlet 24 aligned with the outlet 22 of the compressor, and an outlet 26 that is oriented downstream and opens radially on the outside of the combustion chamber 14.

The diffuser 12 is supported by an external casing 30 which externally surrounds the compressor 10, the diffuser 12 and the combustion chamber 14.

The diffuser 12 comprises an upstream cylindrical ring 32 terminating in an internal annular flange 34 attached by appropriate means of the screw-nut type to a flange 36 of the external casing 30.

The diffuser 12 also comprises a downstream annular end-piece 28 with a substantially L-shaped section that forms an internal casing and that comprises a radial portion 38 that extends inward from the inlet 24 of the diffuser 12 and a substantially cylindrical portion that extends downstream from the radially internal end of the radial portion 38 and comprises at its downstream end an annular flange 40 for attachment to air injection means 42 for ventilating and/or cooling components (mainly turbine components) situated downstream of the combustion chamber 14.

The radial portion 38 of the end-piece 28 extends downstream and along the impeller of the centrifugal compressor in order to delimit with the latter a radial annular passageway 44 communicating at its radially external end with the outlet 22 of the centrifugal compressor.

The combustion chamber 14 has a generally frustoconical shape and is inclined inward from upstream to downstream. It comprises two coaxial walls of revolution 46, 48 extending one inside the other and connected at their upstream ends to a chamber-bottom wall 50, these walls 46, 48 and 50 delimiting between them an annular enclosure into which fuel is brought by injectors (not shown).

The radially external wall 46 of the chamber is attached at its downstream end to the external casing 30, and its radially internal wall 48 is connected at its downstream end to a frustoconical ring 54 that comprises at its radially internal end an internal annular flange 56 for attachment to the aforementioned injection means 42.

The injection means 42 comprise an annular duct 67 whose inlet 68 opens radially outward and is situated downstream of the flange 40 of the end-piece and upstream of the flange 56 of the ring 54, and whose outlet (not shown) is oriented downstream and is situated radially inside the ring 54.

A small portion of the airflow coming out of the centrifugal compressor 10 (arrow 82) enters the radial passageway 44 formed between the impeller of the compressor and the radial portion 38 of the end-piece 28 of the diffuser in order to cool a radially external portion of the impeller of the compressor.

The majority of the air flow coming out of the compressor 10 enters the diffuser 12 (arrow 86) and supplies the combustion chamber 14 (arrows 88) with the internal annular stream 90 and external annular stream 92 traveling round the combustion chamber 14 (arrows 94).

The external stream 92 is formed between the external casing 30 and the external wall 46 of the chamber, and the air that enters this stream 92 is divided into a flow that enters the chamber through holes (not shown) in the wall 46 of the chamber and a flow used for cooling and/or ventilating components (not shown) situated downstream of the chamber.

Figure 2:
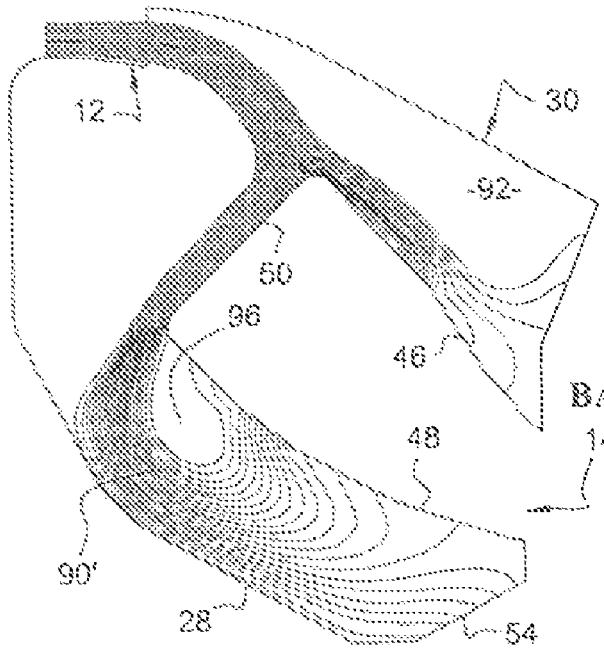
Fig. 2 BACKGROUND ART
FIG. 2 is a modeling of the air flow in a ventilation system according to the prior art.

In the prior art and as shown very schematically in FIG. 2, the internal stream 90' is formed between the end-piece 28 of the diffuser and the internal wall 48 of the chamber, and the air that enters this stream is not guided correctly and is subjected to turbulence and separations of flow that generate considerable pressure losses and reduce the performance of the turbomachine.

The cavity that is between the combustion chamber 14 and the end-piece 28 of the diffuser has a relatively large volume, because of the inclination of the combustion chamber and the shape of the end-piece 28 whose radial portion 38 is used to draw off air from the outlet of the compressor and to guide the drawn-off air in the direction of the axis of rotation, so that the majority of the end-piece 28 is relatively very distant from the internal wall 48 of the combustion chamber.

The portion of the air flow originating from the diffuser 12 and flowing along the chamber-bottom wall 50 then flows along the end-piece 28 of the diffuser, which creates, at the junction between the walls 48 and 50 of the chamber, a zone 96 of flow separation generating considerable turbulence and pressure losses.

The air of the stream 90' is divided into a flow that enters the chamber through the holes (not shown) in the wall 48 of the chamber and a flow that supplies the injection means 42.

The system according to the invention makes it possible to remove the aforementioned disadvantages by creating a stream 90 of stable air flow between the end-piece 28 of the diffuser and the internal wall 48 of the chamber by means of the annular convecting metal sheet 100 arranged radially between the end-piece 28 of the diffuser and the combustion chamber 14.

In the exemplary embodiment of FIG. 1, the annular metal sheet 100 comprises a substantially cylindrical upstream portion 102, a frustoconical intermediate portion 104 that extends downstream inward from the cylindrical portion 102, and a substantially radial downstream portion 106 that extends inward from the downstream end of the intermediate portion 104.

The intermediate portion 104 extends substantially parallel to the internal portion 48 of the chamber and at a short distance from the latter in order to delimit the stream 90 of air flow that travels around the chamber via the inside.

The metal sheet 100 comprises, at its upstream end, a cylindrical rim 108 oriented upstream that is engaged from downstream in an annular groove 110 opening downstream and formed close to the inlet of the diffuser. The groove 110 and the rim 108 make it possible to support and center the case, as will be described in greater detail below.

The radially internal end of the metal sheet 100 is attached by welding at 112 to the injection means 42, downstream of the flange 40 of the end-piece 28 and upstream of the inlet 68 of the injection means 42, so that a portion of the air entering the stream 90 can supply these means 42.

Figure 3:
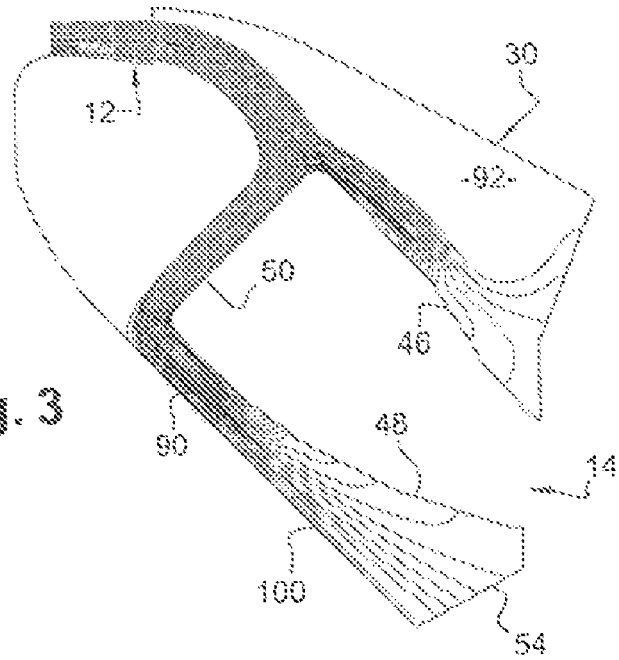
FIG. 3 is a modeling of the air flow in a ventilation system according to the invention.

As shown in the modeling of FIG. 3, the air of this stream 90 is channeled by the convecting metal sheet 100 and the internal wall 48 of the chamber, which makes it possible to prevent the separations and to limit the turbulence and pressure losses.

The metal sheet 100 is mounted in the turbomachine as follows:

After the diffuser 12 and the injection means 42 have been mounted on the centrifugal compressor 10 and before the combustion chamber 14 is assembled to the end-piece 28 of the diffuser, the metal sheet 100 is brought from downstream around the end-piece 28 and then the upstream rim 108 of the metal sheet is fitted into the groove 110 of the diffuser. The radially internal end of the metal sheet 100 is spot-welded or seam-welded to the injection means 42. The chamber is then moved upstream and attached via its ring 54 to the injection means 42.

As a variant, the upstream end of the metal sheet 100 may be welded to the diffuser 12. The downstream end of the metal sheet 100 may also comprise an annular flange for attachment to the injection means 42, this flange being clamped axially between the flange 40 of the end-piece 28 of the diffuser and the means 42.

The metal sheet 100 preferably comprises through-holes (represented schematically at 114 in FIG. 1) to balance the pressures inside and outside the metal sheet.

The invention claimed is:

1. A system for ventilating a combustion chamber wall in a turbomachine comprising:

a centrifugal compressor;

a diffuser;

the combustion chamber including a radially external wall and a radially internal wall;

an internal casing with a substantially L-shaped section that is connected to the diffuser and that extends downstream to air injection means for ventilating a turbine; and an annular convecting metal sheet arranged radially between the combustion chamber and the internal casing and extends axially from the diffuser to the air injection means along the radially internal wall of the combustion chamber in order to delimit, with the radially internal wall of the combustion chamber, an annular stream for the flow of air without separation and with reduced pressure losses, intended to supply holes in the internal wall of the combustion chamber and the air injection means, wherein the metal sheet includes a cylindrical upstream portion, a frustoconical intermediate portion, and a radial downstream portion, wherein a first end of the cylindrical upstream portion is attached to the diffuser, a second end of the cylindrical upstream portion is connected to the frustoconical intermediate portion, and the cylindrical upstream portion between the first end and the second end is parallel to an axis of the turbomachine, and wherein the intermediate portion is substantially parallel to the radially internal wall of the combustion chamber.

2. The system as claimed in claim 1, wherein the first end of the cylindrical upstream portion of the metal sheet is attached by welding to the diffuser.

3. The system as claimed in claim 1, wherein the first end of the cylindrical upstream portion of the metal sheet comprises a cylindrical rim centered and supported by the diffuser.

4. The system as claimed in claim 1, wherein the radial downstream portion of the metal sheet is attached to the air injection means by welding or by bolting of an annular flange.

5. The system as claimed in claim 1, wherein the metal sheet comprises pressure-balancing orifices.

6. The system as claimed in claim 1, wherein the upstream cylindrical portion of the metal sheet comprises a cylindrical rim oriented away from the downstream radial portion of the metal sheet.

7. A turbomachine, which comprises a system for ventilating a combustion chamber wall as claimed in claim 1.

8. The turbomachine as claimed in claim 7, wherein the combustion chamber is inclined inward from upstream to downstream.

9. The system as claimed in claim 3, wherein the cylindrical rim cooperates with an annular groove disposed on the diffuser.

* * * * *